US009605537B2

(12) United States Patent
Hull et al.

(10) Patent No.: US 9,605,537 B2
(45) Date of Patent: Mar. 28, 2017

(54) METHOD AND SYSTEM FOR DETERMINING RELATIVE DEPTH OF AN ACOUSTIC EVENT WITHIN A WELLBORE

(75) Inventors: John Hull, Calgary (CA); Philip Cheuk, Calgary (CA); Seyed Ehsan Jalilian, Calgary (CA)

(73) Assignee: Hifi Engineering Inc., Calgary, Alberta (CA)

( * ) Notice: Subject to any disclaimer, the term of this patent is extended or adjusted under 35 U.S.C. 154(b) by 368 days.

(21) Appl. No.: 14/370,198

(22) PCT Filed: Jan. 6, 2012

(86) PCT No.: PCT/CA2012/000018

§ 371 (c)(1),
(2), (4) Date: Oct. 16, 2014

(87) PCT Pub. No.: WO2013/102252

PCT Pub. Date: Jul. 11, 2013

(65) Prior Publication Data

US 2015/0034306 A1 Feb. 5, 2015

(51) Int. Cl.

| | |
|---|---|
| ***E21B 47/18*** | (2012.01) |
| ***E21B 47/04*** | (2012.01) |
| ***E21B 47/14*** | (2006.01) |

(52) U.S. Cl.

CPC ..... *E21B 47/18* (2013.01); *E21B 47/04* (2013.01); *E21B 47/14* (2013.01)

(58) Field of Classification Search

CPC ..... E21B 47/04; E21B 47/18; E21B 47/14

(Continued)

(56) References Cited

U.S. PATENT DOCUMENTS

| | | | |
|---|---|---|---|
| 2,210,417 | A | 8/1940 | Kinley |
| 4,046,220 | A | 9/1977 | Glenn, Jr. |

(Continued)

FOREIGN PATENT DOCUMENTS

| | | | |
|---|---|---|---|
| WO | WO2011/048373 | A2 | 4/2011 |

OTHER PUBLICATIONS

Optiphase data sheet, 2011, downloaded Sep. 4, 2016 from http://www.optiphase.com/data_sheets/TDI-7000%20Data%20Sheet%20Rev%20D.pdf, 2 pages.*

(Continued)

*Primary Examiner* — Daniel L Murphy
(74) *Attorney, Agent, or Firm* — Klarquist Sparkman, LLP

(57) ABSTRACT

The present disclosure is directed at a method and system for determining relative depth of an acoustic event within a wellbore. The method includes obtaining two acoustic signals at two different and known depths in the wellbore, in which each of the acoustic signals includes the acoustic event; dividing each of the acoustic signals into windows; determining cross-correlations of pairs of the windows, in which each of the pairs includes one window from one of the acoustic signals and another window from the other of the acoustic signals that at least partially overlap each other in time; and determining the relative depth of the acoustic event relative to the two known depths from the cross-correlations. The acoustic event may represent, for example, fluid flowing from formation into the wellbore (or vice-versa) or fluid flowing across any casing or tubing located within the wellbore.

16 Claims, 11 Drawing Sheets

(58) Field of Classification Search
USPC ..... 166/66, 250.01; 367/33
See application file for complete search history.

(56) References Cited

U.S. PATENT DOCUMENTS

| | | | | |
|---|---|---|---|---|
| 4,083,229 | A * | 4/1978 | Anway | G01M 3/243 73/40.5 A |
| 4,289,019 | A * | 9/1981 | Claytor | G01M 3/243 702/51 |
| 4,858,462 | A * | 8/1989 | Coulter | G01M 3/243 73/40.5 A |
| 5,275,040 | A | 1/1994 | Codazzi | |
| 5,349,568 | A * | 9/1994 | Kupperman | G01S 3/8034 367/125 |
| 2006/0133203 | A1 | 6/2006 | James et al. | |
| 2009/0326826 | A1 | 12/2009 | Hull et al. | |
| 2011/0188346 | A1 | 8/2011 | Hull | |
| 2012/0067118 | A1 * | 3/2012 | Hartog | E21B 41/00 73/152.16 |

OTHER PUBLICATIONS

International Search Report and Written Opinion of the International Searching Authority, mailed Mar. 20, 2012, for corresponding International Application No. PCT/CA2012/000018, 9 pages.

* cited by examiner

Channel 1 Vector, Window $w_k$ (400 elements):

[0.0363, 0.0928, 0.0790, 0.1297, 0.1152, 0.1573, 0.1415, ..., -0.0907, -0.1378, -0.1164, -0.1606, -0.1306, -0.1700, -0.1318]

Channel 2 Vector, Window $w_k$ (400 elements):

[-0.0783, -0.0524, -0.0745, -0.0456, -0.0605, -0.0297, ..., 0.0459, 0.0085, 0.0215, -0.0201, -0.0085]

FIG. 2(d)

Lag Matrix for Window Pair $w_k$ (799 elements):

[-0.0001, -0.0004, -0.0005, -0.0001, 0.0002, 0.0014, ..., 0.0130, 0.0114, 0.0101, 0.0077, 0.0054, 0.0027]

FIG. 2(e)

METHOD AND SYSTEM FOR DETERMINING RELATIVE DEPTH OF AN ACOUSTIC EVENT WITHIN A WELLBORE

CROSS REFERENCE TO RELATED APPLICATIONS

This is the U.S. National Stage of International Application No. PCT/CA2012/000018, filed Jan. 6, 2012.

TECHNICAL FIELD

The present disclosure is directed at a method and system for determining relative depth of an acoustic event within a wellbore. More particularly, the present disclosure is directed at a method and system that determines the relative depth of the acoustic event using the cross-correlation of two acoustic signals generated by measuring the acoustic event at different and known depths.

BACKGROUND

During oil and gas drilling, a wellbore is drilled into a formation and then one or more strings of tubing or casing are inserted into the wellbore. For example, surface casing may line an upper portion of the wellbore and protrude out the top of the wellbore; one or both of production tubing and casing may be inserted into the well to facilitate production; and intermediate casing, which is located between the production and surface casings, may also be present in the wellbore.

Gas migration and casing vent flow are both typical problems encountered during oil and gas drilling. For example, gas migration and casing vent flow can refer to any one or more of the following phenomena:

- fluid flowing from the formation into an outermost annular portion of the wellbore behind an outermost casing string in the wellbore;
- fluid flowing from the outermost annular portion of the wellbore into the formation; and
- fluid flowing across any of the casing or tubing strings in the wellbore.

In gas migration and casing vent flow, the moving fluid may be liquid or gaseous, and may eventually leak out of the wellbore and into the atmosphere, which harms the environment. Accordingly, when evidence of gas migration or casing vent flow is found, the location at which the fluid is flowing into the wellbore, the formation, or across the casing or tubing string is identified, and a repair performed. Such a process can be time intensive, costly, and inefficient.

Accordingly, research and development continues into methods and systems that can be used to more robustly and efficiently identify and repair occurrences of gas migration and casing vent flow.

SUMMARY

According to a first aspect, there is provided a method for determining relative depth of an acoustic event within a wellbore. The method includes obtaining two acoustic signals at two different and known depths in the wellbore, wherein each of the acoustic signals includes the acoustic event; dividing each of the acoustic signals into windows, each of which has a certain duration; determining cross-correlations of pairs of the windows, wherein each of the pairs comprises one window from one of the acoustic signals and another window from the other of the acoustic signals that at least partially overlap each other in time; and determining the relative depth of the acoustic event relative to the two known depths from the cross-correlations. The acoustic event may include fluid flowing from formation into the wellbore, fluid flowing from the wellbore into the formation, or fluid flowing across any casing or tubing located within the wellbore.

The method may also include simultaneously measuring the acoustic event at the two different and known depths to generate the two acoustic signals.

Optionally, only the results of the cross-correlations that exceed a minimum cross-correlation threshold may be considered when determining the depth of the acoustic event.

The windows that comprise any one of the pairs of the windows may represent concurrent portions of the acoustic signals. Additionally, the windows into which any one of the acoustic signals is divided do not have to overlap with each other.

Determining the cross-correlations of the pairs of the windows may include, for each of the pairs in a plurality of the pairs of the windows, determining the cross-correlation between the windows of the pair at a plurality of phase differences between the windows of the pair; identifying which of the phase differences corresponds to a maximum cross-correlation between the windows of the pair; and determining whether the acoustic event as measured in the windows of the pair is above the shallower one of the two known depths or below the deeper one of the two known depths from the phase difference that corresponds to the maximum cross-correlation. Determining the relative depth of the acoustic event may include determining how many of the plurality of the pairs indicates that the acoustic event is above the shallower one of the two known depths or below the deeper one of the two known depths; and determining whether the acoustic event is above the shallower one of the two known depths or below the deeper one of the two known depths from how many of the plurality of the pairs indicate that the acoustic event is above the shallower one of the two known depths or below the deeper one of the two known depths.

The method may also include comparing the phase difference that corresponds to the maximum cross-correlation to a maximum time lag; and only using the phase difference that corresponds to the maximum cross-correlation to determine the relative depth of the acoustic event when the phase difference is less than the maximum time lag.

Obtaining the two acoustic signals may include measuring the acoustic event at the two different and known depths using a fiber optic sensor assembly having a fiber optic cable having two pressure sensing regions spaced from each other, in which each of the pressure sensing regions has top and bottom ends and the maximum time lag is the time for sound to travel between the top end of the shallower one of the pressure sensing regions to the bottom end of the deeper one of the pressure sensing regions.

The method may also include comparing the phase difference that corresponds to the maximum cross-correlation to a minimum time lag; and only using the phase difference that corresponds to the maximum cross-correlation to determine the relative depth of the acoustic event when the phase difference exceeds the minimum time lag.

Obtaining the two acoustic signals may include measuring the acoustic event at the two different and known depths using a fiber optic sensor assembly comprising a fiber optic cable having two pressure sensing regions spaced from each other, in which each of the pressure sensing regions has top and bottom ends and the minimum time lag is the time for sound to travel between the bottom end of the shallower one of the pressure sensing regions to the top end of the deeper one of the pressure sensing regions.

The relative depth of the acoustic event may be determined relative to a deeper pair and a shallower pair of the two known depths, and the method may also include determining that the acoustic event is located between the deeper and shallower pairs of the two known depths when a majority of the pairs of windows corresponding to the shallower pair indicates that the acoustic event occurred below the shallower pair and a majority of the pairs of windows corresponding to the deeper pair indicates that the acoustic event occurred above the deeper pair.

The method may also include, prior to determining the cross-correlations of the pairs of the windows, filtering from the acoustic signals frequencies exceeding 20,000 Hz. Additionally or alternatively, the method may also include, prior to determining the cross-correlations of the pairs of the windows, filtering out of the acoustic signals frequencies outside of between about 10 Hz to about 200 Hz, between about 200 Hz to about 600 Hz, between about 600 Hz and 1 kHz, or about 1 kHz and greater. These frequencies may be filtered out of the acoustic signals in parallel. More generally, any number of filters of varying types and having different cutoff frequencies can be used to condition the acoustic signals in parallel. For example, any one or more of bandpass filters, lowpass filters, and highpass filters of any suitable passband may be used to condition the acoustic signals in parallel to isolate desired frequencies of the acoustic signals for further analysis.

According to another aspect, there is provided a system for determining relative depth of an acoustic event within a wellbore. The system includes a fiber optic sensor assembly having a fiber optic cable having two pressure sensing regions spaced from each other, in which the fiber optic sensor assembly is configured to measure the acoustic event using the two pressure sensing regions and to correspondingly output two analog acoustic signals; a spooling mechanism on which the fiber optic cable is wound and that is configured to lower and raise the fiber optic cable into and out of the wellbore; a data acquisition box communicatively coupled to the fiber optic assembly and configured to digitize the acoustic signals; a processor communicatively coupled to the data acquisition box to receive the acoustic signals that have been digitized and to a computer readable medium having encoded thereon statements and instructions to cause the processor to perform any aspects of the method described above.

According to another aspect, there is provided a computer readable medium having encoded thereon statements and instructions to cause a processor to perform any aspects of the method described above.

BRIEF DESCRIPTION OF THE DRAWINGS

In the accompanying drawings, which illustrate one or more exemplary embodiments:

FIG. 2(*b*) depicts the acoustic signals of FIG. 1, in which each of the signals is divided into windows.

FIG. 2(*c*) depicts one of the windows of FIG. 2(*b*).

FIG. 2(*d*) shows matrices representing the portion of the signals shown in FIG. 2(*c*).

FIG. 2(*e*) shows the lag matrix resulting from determining the cross-correlation of the portion of the signals shown in FIG. 2(*c*).

FIG. 2(*f*) shows a graph of the lag matrix of FIG. 2(*e*).

DETAILED DESCRIPTION

Directional terms such as "top," "bottom," "upwards," "downwards," "vertically" and "laterally" are used in the following description for the purpose of providing relative reference only, and are not intended to suggest any limitations on how any article is to be positioned during use, or to be mounted in an assembly or relative to an environment.

Casing vent flow (CVF) and gas migration (GM) are problems that are becoming increasingly important in the oil and gas industry. CVF and GM may occur at any time during the life of a wellbore: while the wellbore is being drilled (pre-production); while the wellbore is being used to produce oil or gas; and while the wellbore is abandoned. The fluid migration that occurs within the wellbore during CVF and GM typically commences with fluid, such as a gaseous or liquid hydrocarbon, entering the wellbore from the formation into which the wellbore was drilled, entering the formation from the wellbore, or crossing any of the tubing or casing strings within the wellbore. When the fluid enters the wellbore from the formation or crosses the tubing or casing string (hereinafter collectively referred to as "leaks"), it makes a noise (hereinafter referred to as an "acoustic event"). This acoustic event can be detected using well logging.

The embodiments described herein are directed at a method and system for determining the relative depth of the acoustic event, which corresponds to the source of the CVF or GM. Once the source of the CVF or GM is located, repairs can be performed to end the CVF or GM. For example, if the CVF or GM is being caused by a crack in a tubing or casing string, this crack can be plugged. The following embodiments determine the depth of the acoustic event relative to two different depths at which the acoustic event is measured from cross-correlations of portions of the signals generated at those two different depths.

Figure 1:
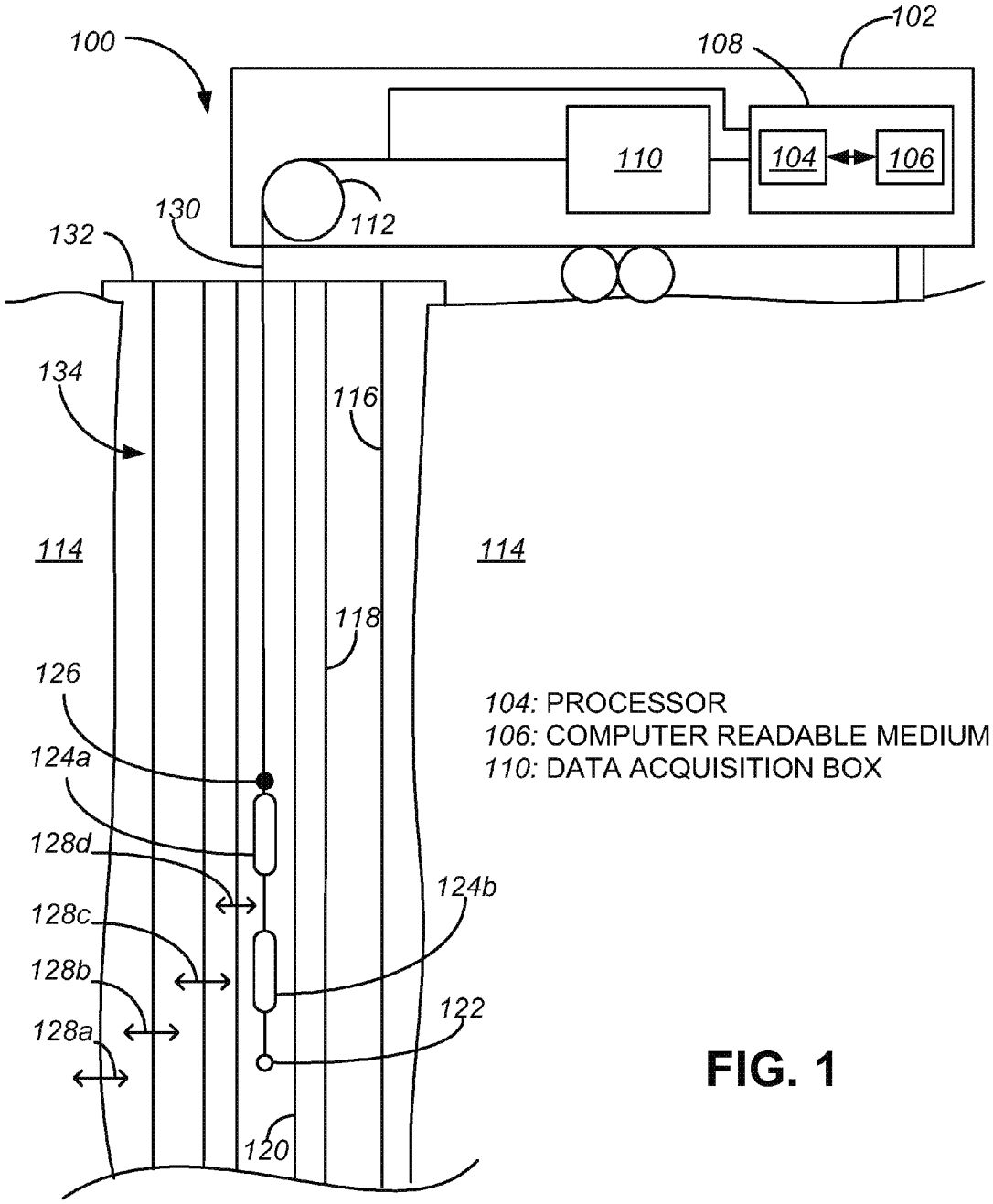
FIG. 1 shows a schematic of a system for determining relative depth of an acoustic event within a wellbore, according to one embodiment.
Figure 2A:
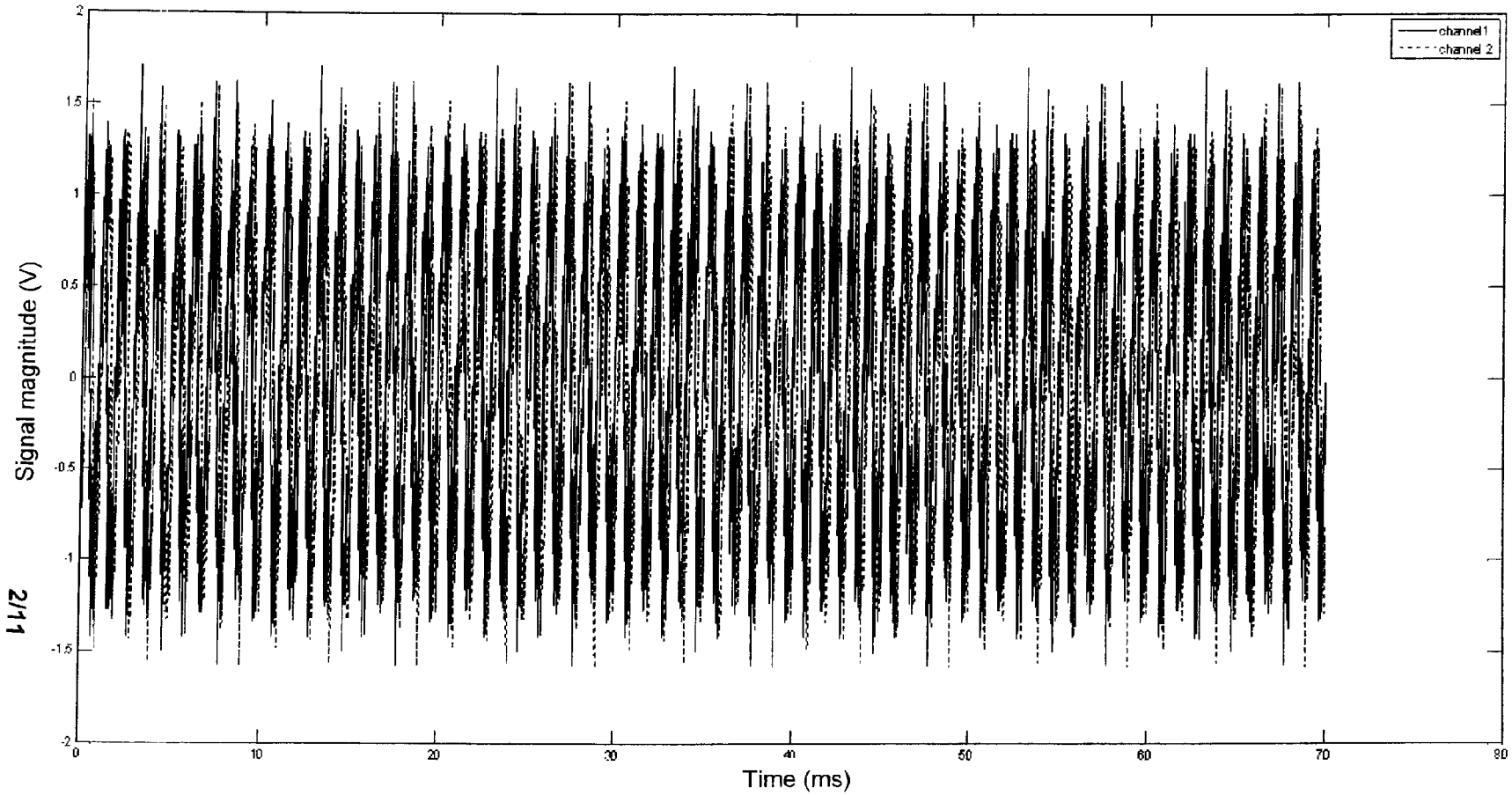
FIG. 2(*a*) depicts a pair of acoustic signals acquired using the system of FIG. 1.
Figure 2B:
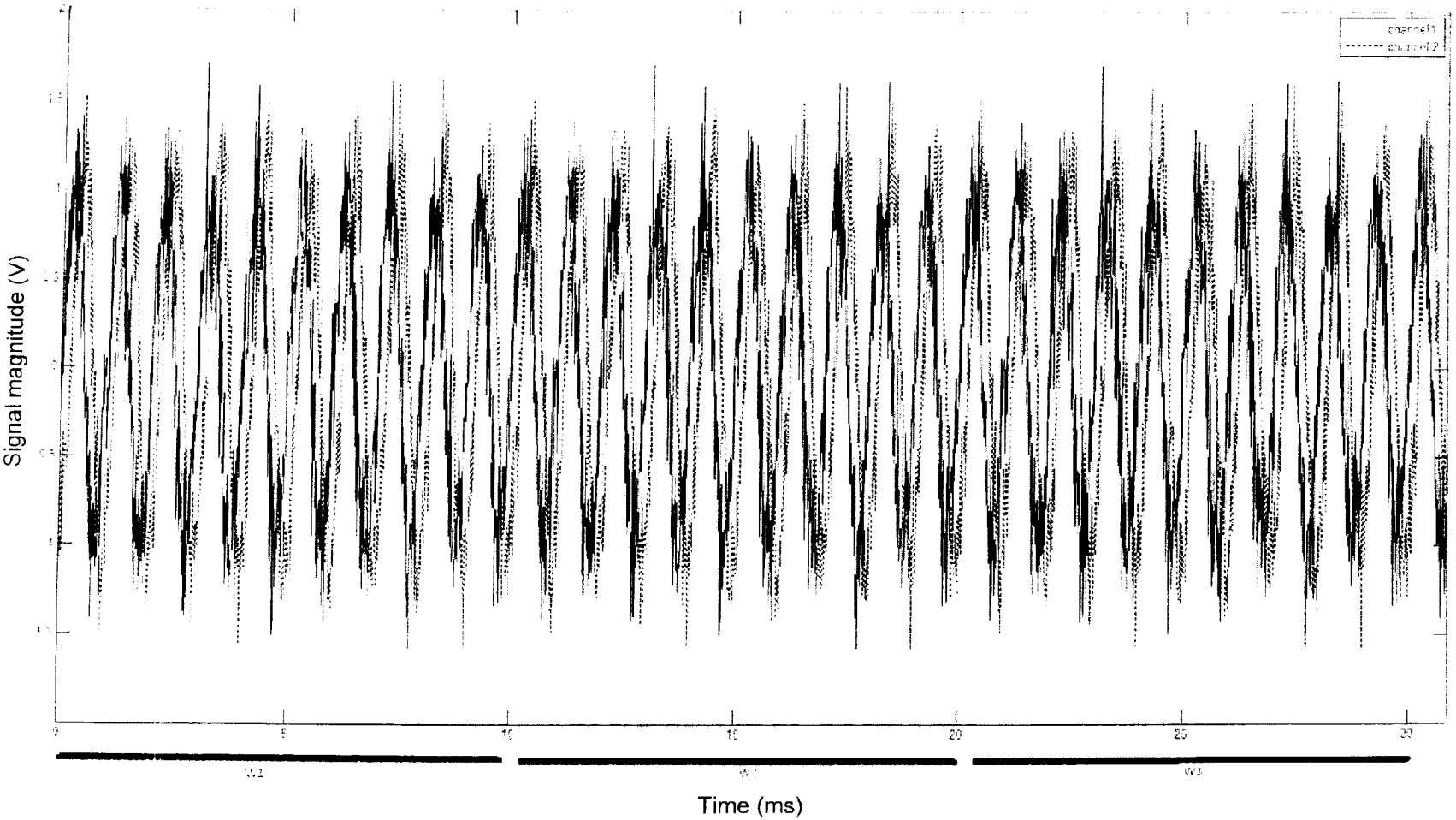
Figure 2C:
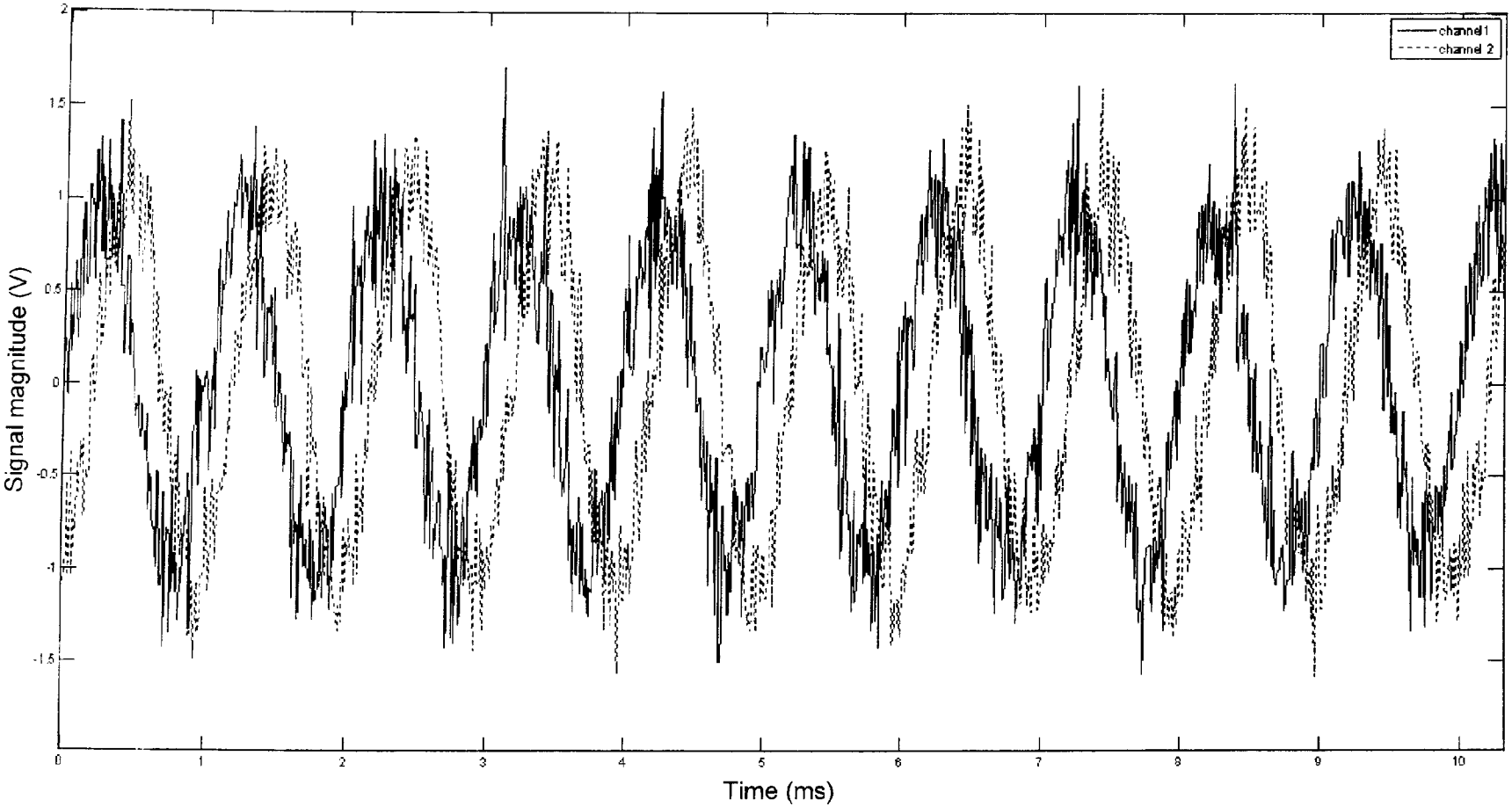
Figure 2F:
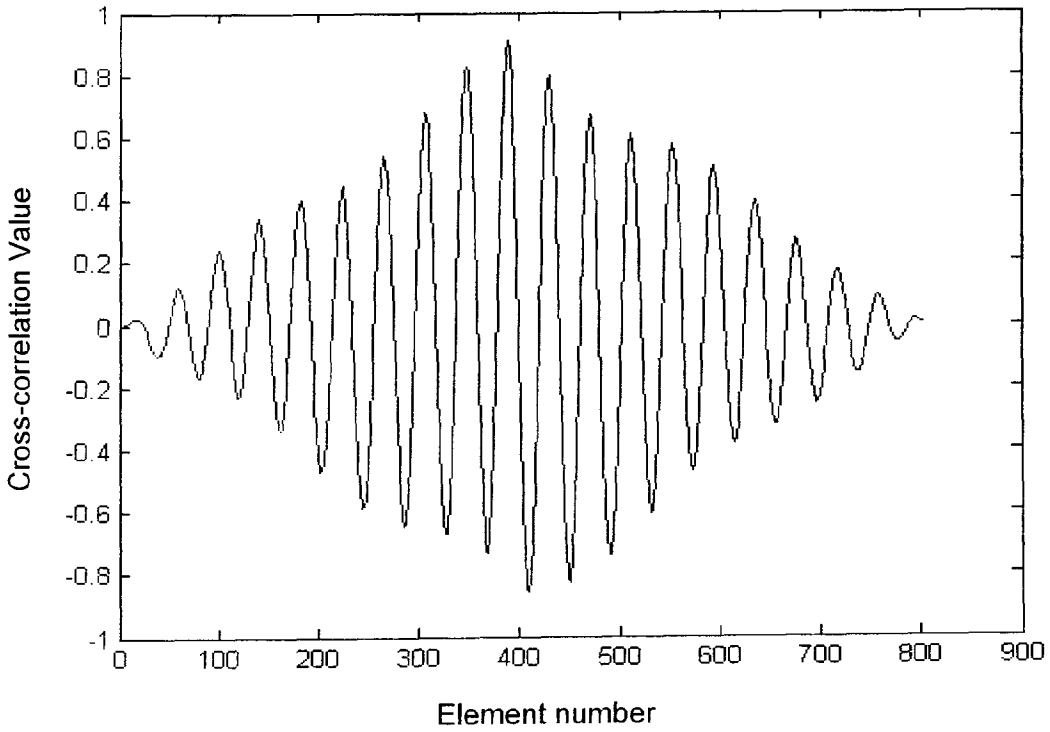

Referring now to FIG. 1, there is shown a schematic of a system for determining relative depth of an acoustic event within a wellbore, according to one embodiment. In FIG. 1, a wellbore 134 is drilled into a formation 114 that contains oil or gas deposits (not shown). Various casing and tubing strings are then strung within the wellbore 134 to prepare it for production. In FIG. 1, surface casing 116 is the outermost string of casing and circumscribes the portion of the interior of the wellbore 134 shown in FIG. 1. A string of production casing 118 with a smaller radius than the surface casing 116 is contained within the surface casing 116, and an annulus (unlabeled) is present between the production and surface casings 118, 116. A string of production tubing 120 is contained within the production casing 118 and has a smaller radius than the production casing 118, resulting in another annulus (unlabeled) being present between the production tubing and casing 120, 118. The surface and production casings 116, 118 and the production tubing 120 terminate at the top of the wellbore 134 in a wellhead 132 through which access to the interior of the production tubing 120 is possible.

Although the wellbore 134 in FIG. 1 shows only with the production and surface casings 118, 116 and the production tubing 120, in alternative embodiments (not shown) the wellbore 134 may be lined with more, fewer, or alternative types of tubing or casing. For example, in one such alternative embodiment a string of intermediate casing may be present in the annulus between the surface and production casings 116, 118. In another such alternative embodiment in which the wellbore 134 is pre-production, only the surface casing 116, or only the surface and production casings 116, 118, may be present.

FIG. 1 also shows four examples of leaks 128*a-d* (collectively, "leaks 128") that result in acoustic events. One of the leaks 128*a* is of fluid crossing the formation 114's surface. Another of the leaks 128*b* is of fluid crossing the surface casing 116, while a third leak 128*c* is of fluid crossing the production casing 118, and a fourth leak 128*d* is of fluid crossing the production tubing 120. Although not depicted in FIG. 1, fluid flowing into the formation 114 from the wellbore 134 can also constitute a leak. As mentioned above, in alternative embodiments (not shown) the wellbore 134 may contain more, fewer, or other types of casing or tubing strings, and in such embodiments the leaks may result from fluid crossing any or more of these strings.

Lowered through the wellhead 132 and into the wellbore 134, through the production tubing 120, is a fiber optic sensor assembly. The fiber optic sensor assembly includes a fiber optic cable 130 that is optically coupled, via an optical connector 126, to a pair of pressure sensing regions 124: a shallower pressure sensing region 124*a* that is located at a shallower depth than a deeper pressure sensing region 124*b*. Each of the pressure sensing regions 124 is located along its own fiber optic strand and is sensitive to strains that result from detection of the acoustic event. The fiber optic assembly also includes a weight 122 coupled below the lower pressure sensing region 124*b* to help ensure the fiber optic cable 130 is relatively taut during well logging. An exemplary fiber optic sensor assembly is described, for example, in PCT patent application having serial number PCT/CA2008/000314, publication number WO/2008/098380, and entitled "Method and Apparatus for Fluid Migration Profiling", the entirety of which is hereby incorporated by reference herein. In an alternative embodiment (not depicted), a single fiber strand that has multiple pressure sensing regions on it may be used, with the signals from the multiple pressure sensing regions being multiplexed back to the surface.

The fiber optic strands themselves may be made from quartz glass (amorphous $SiO_2$). The fiber optic strands may be doped with a rare earth compound, such as germanium, praseodymium, or erbium oxides, to alter their refractive indices. Single mode and multimode optical strands of fiber are commercially available from, for example, Corning® Optical Fiber. Exemplary optical fibers include ClearCurve™ fibers (bend insensitive), SMF28 series single mode fibers such as SMF-28 ULL fibers or SMF-28e fibers, and InfiniCor® series multimode fibers.

When the pressure sensing regions 124 detect the acoustic event, they generate acoustic signals that are transmitted to the surface. Each of the pressure sensing regions generates one acoustic signal. The acoustic signal generated by the pressure sensing regions is transmitted along the fiber optic cable 130, past a spooling device 112 around which the fiber optic cable 130 is wrapped and that is used to lower and raise the cable 130 into and out of the wellbore 134, and to a data acquisition box 110. As discussed in more detail with respect to FIGS. 2(*a*)-(*c*), below, the data acquisition box 110 digitizes the acoustic signals and sends them to a signal processing device 108 for further analysis. The digital acquisition box 110 may be, for example, an Optiphase™ TDI-7000.

The signal processing device 108 is communicatively coupled to both the data acquisition box 110 to receive the digitized acoustic signals and to the spooling device 112 to be able to determine the depths at which the acoustic signals were generated (i.e. the depths at which the acoustic event was measured), which the spooling device 112 automatically records. The signal processing device 108 includes a processor 104 and a computer readable medium 106 that are communicatively coupled to each other. The computer readable medium 106 includes statements and instructions to cause the processor 104 to perform any one or more of the exemplary methods depicted in FIGS. 4 to 6, below, which are used to determine the relative depth of the acoustic event.

Figure 4:
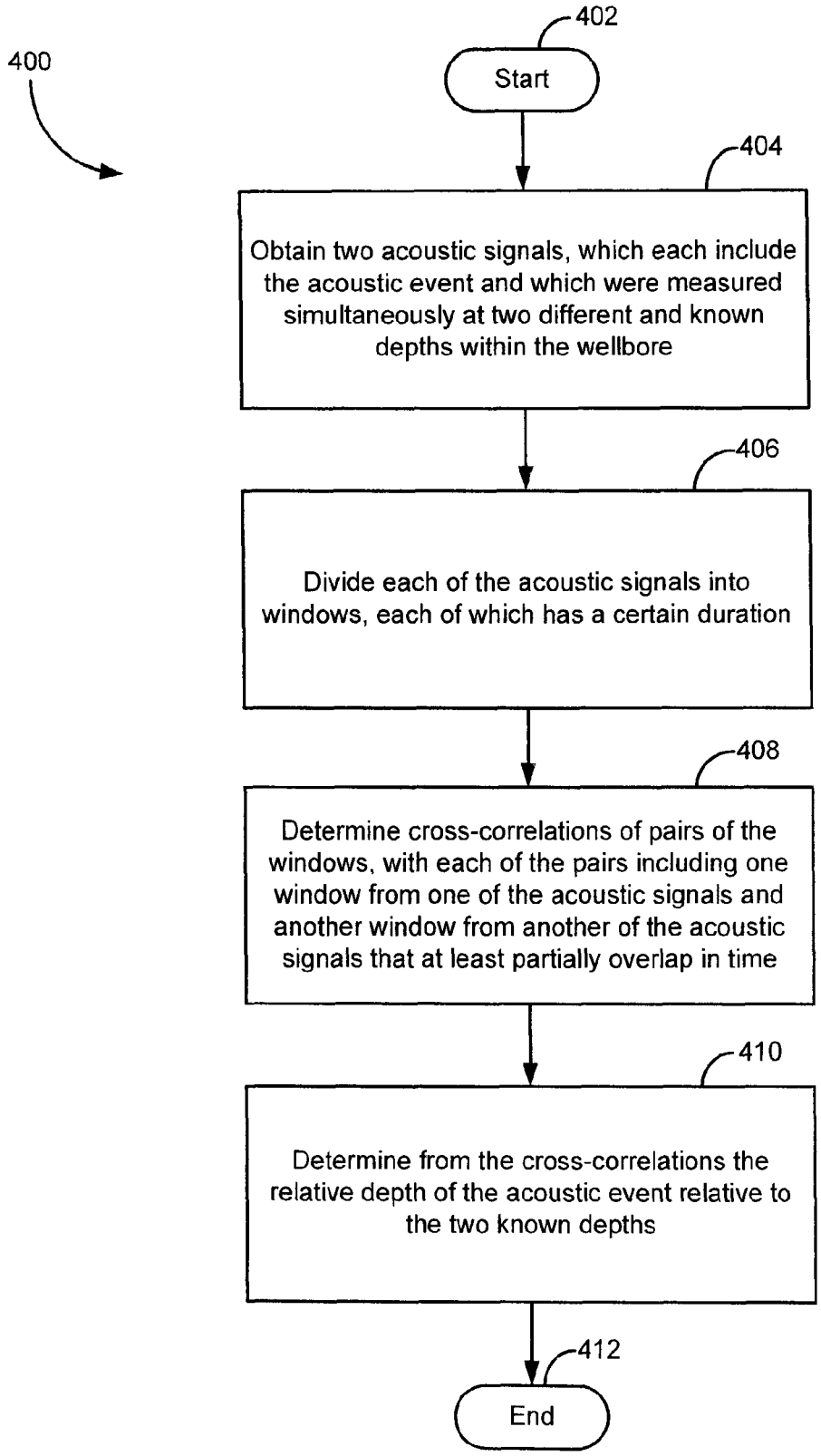
FIG. 4 depicts a method for determining the relative depth of the acoustic event, according to another embodiment.

Referring now to FIG. 4, there is shown a method 400 for determining the relative depth of the acoustic event within the wellbore, according to another embodiment. The method 400 may be encoded on to the computer readable medium 106 to cause the processor 104 to perform the method 400 on the acoustic signals that the signal processing device 108 receives from the data acquisition box 110. At block 402, the processor 104 begins performing the method 400. At block 404, the processor 104 acquires the acoustic signals from the data acquisition box 110. As mentioned above, because each of the acoustic signals is generated using one of the pressure sensing regions 124, the depths of which are known from the spooling device 112, the processor 104 knows the depths at which each of the acoustic signals was measured.

Although not shown in FIG. 4, the processor 104 filters the acoustic signals prior to performing any further signal processing on them. While acoustic events that are audible to the human ear typically range from about 20 Hz to 20 kHz, empirically it has been found that the acoustic events that correspond to CVF and GM range from about 20 Hz to 2 kHz. In order to condition the signal for further processing, in the depicted embodiment the processor 104 filters the acoustic signals through a 10 Hz high pass filter, and then in parallel through a bandpass filter having a passband of between about 10 Hz to about 200 Hz, a bandpass filter having a passband of about 200 Hz to about 600 Hz, a bandpass filter having a passband of about 600 Hz to about 1 kHz, and a high pass filter having a passband of about 1 kHz and greater. The processor 104 can digitally implement the filters as, for example, $5^{th}$ or $6^{th}$ order Butterworth filters. By filtering the acoustic signals in parallel in this manner, the processor 104 is able to isolate different types of the acoustic events that correspond to the passbands of the filters. An example of two acoustic signals corresponding to one of these passbands and generated simultaneously from measuring the same acoustic event at different depths is shown in FIG. 2(*a*).

In an alternative embodiment (not shown), the filtering performed on the acoustic signals may be analog, or a mixture of analog and digital, in nature, and may be partially or entirely performed outside of the signal processing device 108, such as in the data acquisition box 110. Alternative types of filters, such as Chebychev or elliptic filters with more or fewer poles than those of the Butterworth filters discussed above may also be used, for example in response to available processing power.

At block 406 the processor 104 divides each of the acoustic signals into windows $w_1 \ldots w_n$. To illustrate this, the signals shown in FIG. 2(*a*) are divided into windows, and the first three windows $w_1 \ldots w_3$ for each of the signals are shown in FIG. 2(*b*). The outputs of each of the filters that filter the acoustic signals in parallel are divided into windows; in the above example in which four different filters are used to filter the acoustic signals in parallel, four different sets of signals are windowed. For any given integer $k \in [1 \ldots n]$, $w_k$ for one of the acoustic signals and $w_k$ for the other of the acoustic signals together constitute a pair of the windows, or a "window pair", $w_{k_pair}$. In the depicted embodiment, because each of the windows $w_1 \ldots w_r$, for the acoustic signals have identical start and end times, any given window pair $w_{k_pair}$ for the acoustic signals represents concurrent portions of the signals. The duration chosen for each of the windows may be related to the cutoff frequency of the filters used to condition the acoustic signals. For example, where the center frequency of a band pass filter is 2 kHz, a typical duration for each of the windows is 10×(½ kHz)=0.005 s. This ensures that about 10 cycles of the desired frequency are processed in each window.

Figure 5:
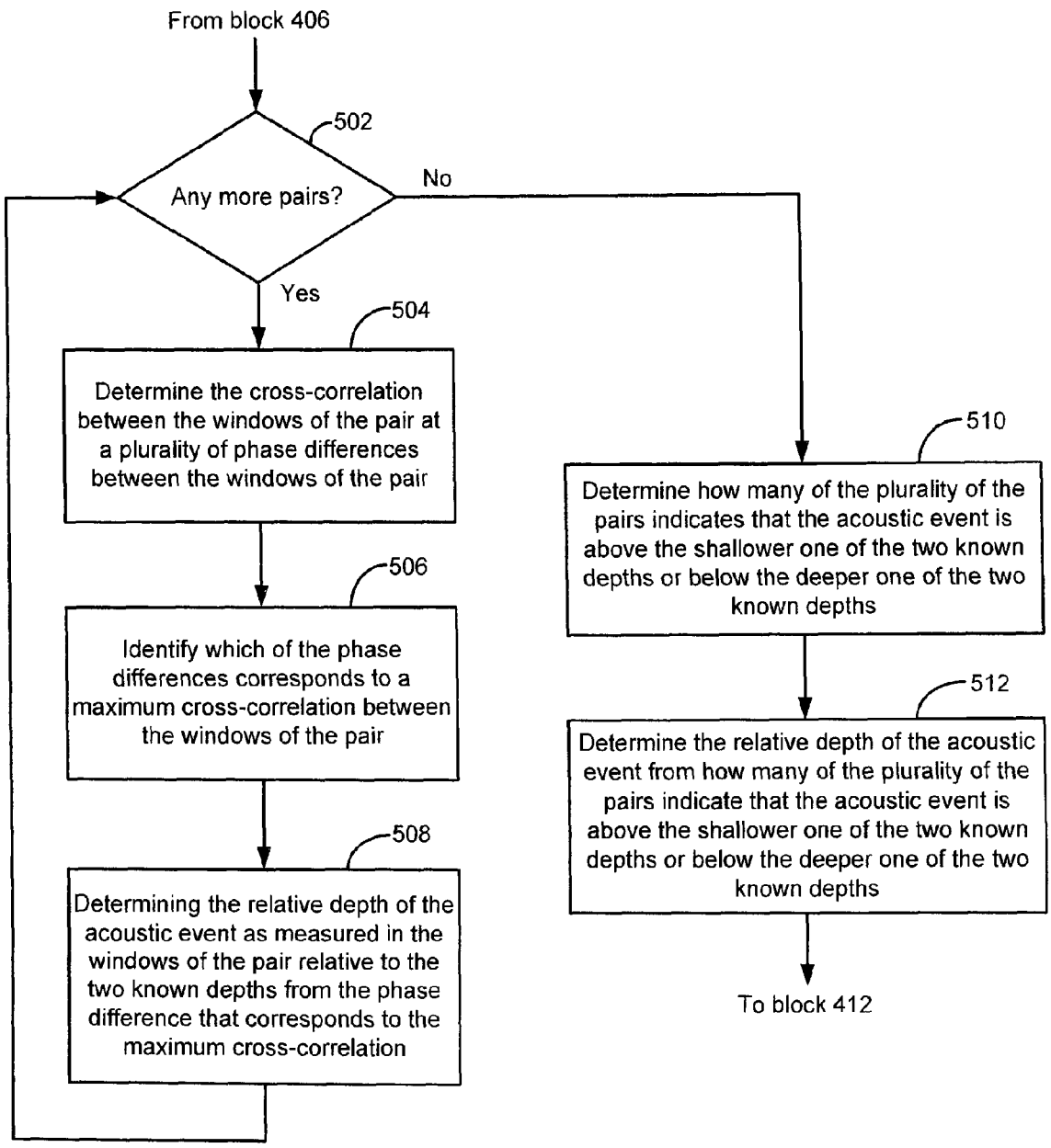
FIG. 5 depicts a method for determining the relative depth of the acoustic event from the results of cross-correlations performed on the windows of two acoustic signals, according to another embodiment.

After dividing the acoustic signals into the windows $w_1 \ldots w_n$, the processor 104 at block 408 determines the cross-correlations of each of the window pairs $w_{k_pair}$ for $k \in [1 \ldots n]$, and from these cross-correlations determines, at block 410, the relative depth of the acoustic event relative to the known depths of the pressure sensing regions 124. Referring now to FIG. 5, there is shown one embodiment of a method by which the processor 104 may perform blocks 408 and 410.

At block 502, which the processor performs following block 406, the processor 104 determines whether there are any more window pairs $w_{k_pair}$ for which the cross-correlation has not yet been determined. If any such window pairs $w_{k_pair}$ remain, the processor 104 proceeds to block 504 where it determines the cross-correlation between the acoustic signals for one of the window pairs $w_{k_pair}$ at multiple phase differences between the windows of the window pair $w_{k_pair}$. The manner in which the processor 104 does this can be explained with reference to FIGS. 2(*c*)-(*e*).

FIG. 2(*c*) shows one exemplary window pair $w_{k_pair}$ of the acoustic signals, while FIG. 2(*d*) represents the two acoustic signals as shown in FIG. 2(*c*) in vector form. In FIG. 2(*d*), the acoustic signal generated using the shallower pressure sensing region 124*a* is referred to as the "Channel 1 Vector", while the acoustic signal generated using the deeper pressure sensing region 124*b* is referred to as the "Channel 2 Vector". At block 504, the processor 104 determines the cross-correlation between the vectors of FIG. 2(*d*) for the window pair $w_{k_pair}$ to generate a lag matrix for the window pair $w_{k_pair}$, which is shown in FIG. 2(*e*). The lag matrix for the window pair $w_{k_pair}$ may be generated using, for example, the xcorr function in Matlab™, by inputting xcorr(channel 1 vector for window $w_k$, channel 2 vector for window $w_k$). Where each of the channel 1 and 2 vectors are a 1×n matrix, the lag matrix will be a matrix of 1×(2n−1). For example, in FIGS. 2(*d*) and (*e*), each of the channel 1 and 2 vectors are a 1×400 matrix, while the lag matrix is a 1×799 matrix.

Each position in the lag matrix corresponds to the cross-correlation between the channel 1 and 2 vectors at a particular phase difference between the vectors. Where the lag matrix has 1 to (2n−1) elements, the element at position n corresponds to there being no phase difference between the channel 1 and 2 vectors, the elements between positions (n+1) and (2n−1) correspond to the channel 2 vector leading the channel 1 vector, and the elements between positions 1 and (n−1) correspond to the channel 1 vector leading the channel 2 vector. The farther away from position n in the lag matrix, the greater is the lag between the channel 1 and 2 vectors.

Following determining the cross-correlations for the channel 1 and 2 vectors for one of the window pairs $w_{k_pair}$, the processor 104 proceeds to block 506 where it identifies at which phase difference the maximum cross-correlation between the windows of the window pair $w_{k_pair}$ occurred. In the exemplary lag matrix of FIG. 2(*d*) that has 799 elements (n=400), the maximum cross-correlation occurs at index (n−11) or index 389, which indicates that channel 1 leads channel 2. This is illustrated in FIG. 2(*e*), which is a graph of the lag matrix of FIG. 2(*d*).

Figure 6:
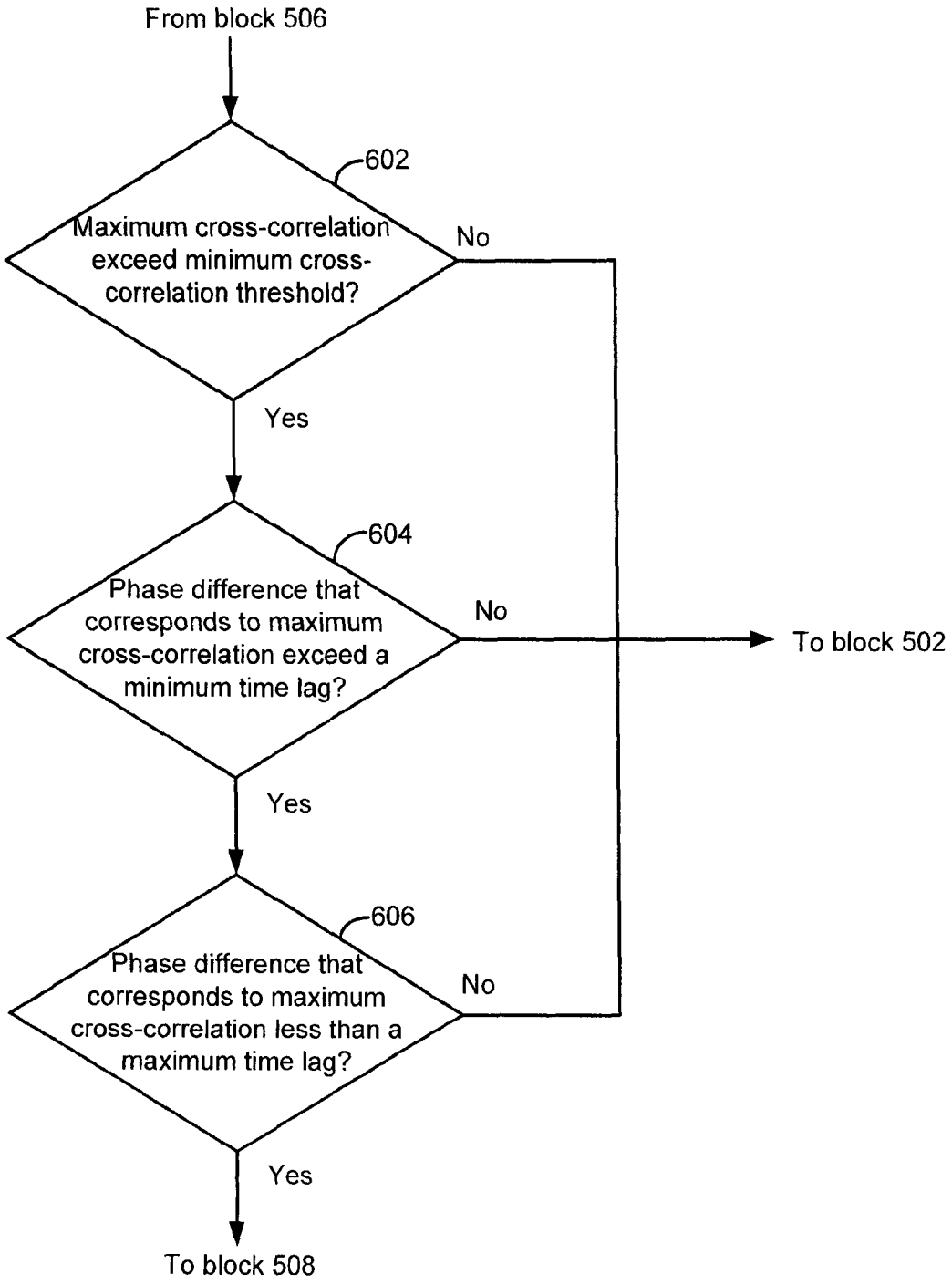
FIG. 6 depicts a method by which only the cross-correlations that satisfy certain criteria are used to determine the relative depth of the acoustic event, according to another embodiment.

Prior to using the lag matrix to determine the relative depth of the acoustic event, the processor 104 in the depicted embodiment first determines whether the lag matrix contains usable data at all by applying the criteria shown in FIG. 6. Following generation of the lag matrix during block 506, the processor 104 proceeds to block 602 where it determines whether the maximum cross-correlation exceeds a minimum cross-correlation threshold. The minimum cross-correlation threshold is empirically determined and is set to help reduce the prejudicial effect of those cross-correlations that are not indicative of correlation between the acoustic event as recorded in the two acoustic signals, but rather correlations that result from artefacts such as interference or noise. When one or both of interference and noise are relatively low, the minimum cross-correlation threshold may be set relatively high (e.g.: 0.8). In contrast, when one or both of interference and noise are relatively high, the minimum cross-correlation threshold is typically lowered (e.g. to 0.3) as the ability to distinguish between the two acoustic signals is reduced on account of the interference and noise. Interference and noise may be relatively low, for example, when measurements are taken relatively far from the bottom of the wellbore 134, which can help reduce acoustic reflections. In the depicted embodiment, the minimum cross-correlation threshold is set to 0.8. The maximum cross correlation at index (n−11) of the lag matrix is 0.9121, and accordingly the processor 104 proceeds from block 602 to block 604.

Figure 3:
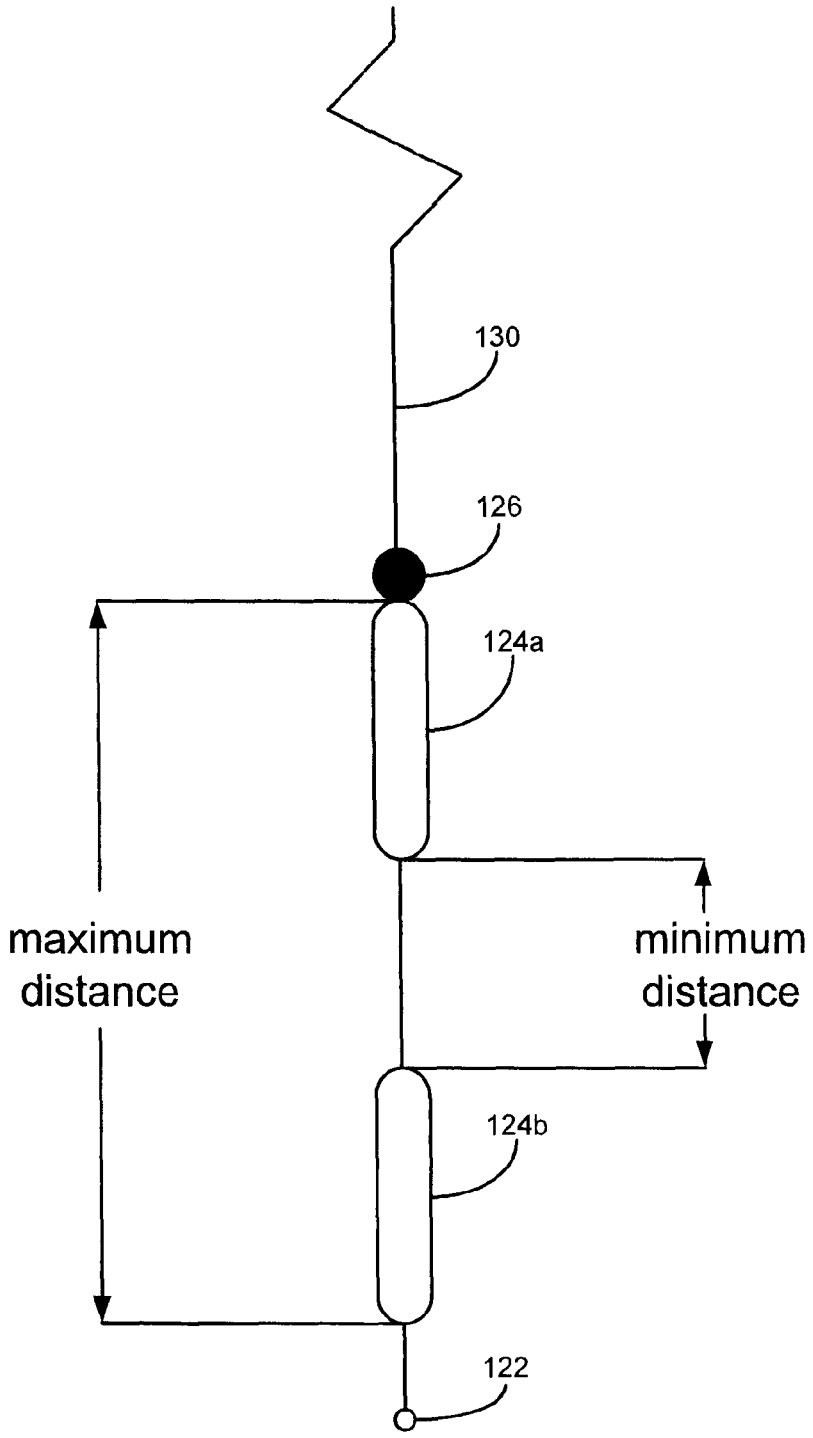
FIG. 3 depicts a detailed view of two pressure sensing regions that form part of the fiber optic sensor assembly used in the system of FIG. 1.

At block 604, the processor 104 determines whether the phase difference that corresponds to the maximum cross-correlation of 0.9121 exceeds a minimum time lag. The minimum time lag corresponds to the minimum amount of time the acoustic event takes to travel from one of the pressure sensing regions 124 to the other of the pressure sensing regions 124 before being detected by both of the regions 124. FIG. 3 shows a detailed view of the bottom of the fiber optic sensor assembly. As the pressure sensing regions 124 are distributed sensors, the acoustic signals may be generated as a result of the acoustic event being detected anywhere along the length of the pressure sensing regions. Consequently, the minimum time that passes between the acoustic event being detected in the two acoustic signals corresponds to the time it takes for sound to travel from the bottom end of the shallower pressure sensing region 124*a* to the top end of the deeper pressure sensing region 124*b*. This distance is labelled "minimum distance" in FIG. 3, and the time it takes for the acoustic event to travel the minimum distance is the (minimum distance)/(speed of sound in the wellbore 134). In an exemplary embodiment, the minimum distance is 0.108 m, the wellbore 134 is filled with a fluid that is mainly water and in which sound travels 1484 m/s, and the minimum time lag is accordingly 0.0000728 s. Only considering those cross-correlations associated with phase differences that exceed the minimum time lag eliminates from consideration acoustic events whose source is between the bottom of the shallower pressure sensing region 124*a* and the top of the deeper pressure sensing region 124*b*.

In the lag matrix of FIG. 2(*e*), each index corresponds to 1/400 of the length of the window, which is 0.010 s. Accordingly, as the maximum correlation occurs 11 units away from the index that corresponds to no lag, the lag that corresponds to the maximum cross-correlation is 11/400*0.010=0.000275 s. 0.000275 s exceeds the minimum time lag, and the processor 104 accordingly proceeds to block 606 where it determines whether the phase difference that corresponds to the maximum cross-correlation is less than a maximum time lag.

Again referring to FIG. 3, the maximum time lag corresponds to the maximum amount of time the acoustic event takes to travel from one of the pressure sensing regions 124 to the other of the pressure sensing regions 124 before being detected by both of the regions 124. Analogous to the comments made, above, regarding the minimum time lag, the maximum time lag corresponds to the time it takes for sound to travel from the top end of the shallower pressure sensing region 124*a* to the bottom end of the deeper pressure sensing region 124*b*. This distance is labelled "maximum distance" in FIG. 3, and the time it takes for the acoustic event to travel the maximum distance is the (maximum distance)/(speed of sound in the wellbore 134). In the exemplary embodiment, the maximum distance is 0.75 m, and the maximum time lag is accordingly 0.0005054 s. As the time delay that corresponds to the maximum cross-correlation is 0.000275 s, the processor 104 accordingly proceeds to block 508 where it determines the relative depth of the acoustic event based on the maximum cross-correlation. Only considering those phase cross-correlations associated with phase differences less than the maximum time lag eliminates from consideration measurement artefacts such as acoustic reflections.

In FIG. 3, the minimum and maximum distances are determined relative to the top and bottom of the pressure sensing regions 124. However, in alternative embodiments (not depicted), these distances may be determined relative to different points on the regions 124. For example, it may be assumed for convenience that any measurements obtained using the regions 124 are obtained at the their midpoint, thus making the maximum and minimum distances equal to each other. Alternatively, instead of distributed sensing regions, non-distributed point sensors may be used, which also results in the minimum and maximum distances being equal to each other.

If the maximum cross-correlation had been less than the minimum cross-correlation threshold or if the phase difference at which the maximum cross-correlation occurred had been lower than the minimum time lag or higher than the maximum time lag, the processor 104 would have disregarded the current window pair $w_{k_pair}$ and not have proceeded to block 508, and would instead have proceeded to block 502 in order to evaluate the next window pair $w_{k_pair}$.

At block 508, the processor 104 determines the relative depth of the acoustic event for the window pair $w_{k_pair}$. If the acoustic signal measured using the deeper pressure sensing region 124*b* leads, in phase, the acoustic signal measured using the shallower pressure sensing region 124*a*, the acoustic event is below the deeper pressure sensing region 124*b*. Analogously, if the acoustic signal measured using the shallower pressure sensing region 124*a* leads the acoustic signal measured using the deeper pressure sensing region 124*b*, the acoustic event is above the shallower pressure sensing region 124*a*.

In the exemplary lag matrix shown in FIG. 2(*e*), the maximum cross-correlation occurs when the channel 1 vector leads the channel 2 vector; i.e., when the acoustic signal measured using the shallower pressure sensing region 124*a* is the leading acoustic signal. Accordingly, the processor 104 determines that for the window pair $w_{k_pair}$, the acoustic event is above the shallower pressure sensing region 124*a*. The processor 104 records in the computer readable medium 106 or another suitable memory that for the window pair $w_{k_pair}$ the acoustic event is above the shallower pressure sensing region 124*a*.

The processor 104 then returns to block 502 to determine whether there are any more window pairs $w_{k_pair}$ to analyze. If there are, the processor repeats blocks 504 to 508 as described above, each time recording whether the window pair $w_{k_pair}$ indicates that the acoustic event is above the shallower pressure sensing region 124*a* or below the deeper pressure sensing region 124*b*.

When the processor 104 has analyzed all of the window pairs $w_{k_pair}$, it proceeds to block 510. At block 510 is determines how many of the total number of window pairs $w_{k_pair}$ indicate that the acoustic event is shallower than the shallower pressure sensing region 124*a* versus how many indicate the acoustic event is deeper than the deeper pressure sensing region 124*b*. Ideally, assuming no measurement artefacts such as reflections, interference, presence of multiple acoustic events, or noise, all of the window pairs $w_{k_pair}$ would indicate the same thing: that the acoustic event is either above the pair of pressure sensing regions 124 or below. However, because of non-idealities, the cross-correlations of the different windows $w_k$ may not uniformly indicate that the acoustic event is above or below the pair of pressure sensing regions 124, particularly as the acoustic event gets relatively close to the pressure sensing regions 124. By dividing the acoustic signals into the window pairs $w_{k_pair}$, k calculations can be considered as opposed to a single calculation for the entire duration of the acoustic signal, resulting in more accurate results.

For example, in the depicted embodiment when the deeper pressure sensing region 124*b* is at a depth of 1,500 m, at block 510 the processor 104 may determine that 60% of the window pairs $w_{k_pair}$ indicate that the acoustic event is occurring below the deeper pressure sensing region 124*b* while 40% of the window pairs $w_{k_pair}$ indicate that the acoustic event is occurring above the shallower pressure sensing region 124*a*. Empirically, a percentage threshold may be set above which the processor 104 or a user of the system 100 concludes from the percentage of window pairs $w_{k_pair}$ what the relative depth of the acoustic event is. For example, at block 512, if the threshold is 40%, and 60% of the window pairs $w_{k_pair}$ indicate that the acoustic event is above the shallower pressure sensing region 124*a*, the processor 104 or user may conclude that the acoustic event is above the shallower pressure sensing region 124*a*. After determining the relative depth of the acoustic event by analyzing the cross-correlations of all the window pairs $w_{k_pair}$, the processor 104 proceeds to block 412 and the method 400 ends.

According to another embodiment (not depicted), the processor 104 may position the fiber optic sensor assembly at different depths, determine the relative depth of the acoustic event at these different depths, and use the analysis performed at different depths to more accurately determine relative position of the acoustic event. For example, the fiber optic sensor assembly may first be positioned such that the deeper pressure sensing region 124*b* is at a depth of 500 m, at which 70% of the window pairs $w_{k_pair}$ indicate that the acoustic event is below the deeper pressure sensing region 124*b*. The fiber optic sensor assembly may then be moved such that the shallower pressure sensing region 124*a* is at a depth of 510 m, at which 70% of the window pairs $w_{k_pair}$, indicate that the acoustic event is above the shallower pressure sensing region 124*a*. The combination of these two readings allows the processor 104 or the user to determine with a relatively high degree of confidence that the acoustic event is between 500 m and 510 m.

During a typical well logging session, hundreds of measurements may be taken in the wellbore 134. For example, if the wellbore 134 is 400 m, it may be logged in 5 m intervals beginning at the surface where the depth is 0 m. At each 5 m interval, the data acquisition box 110 may acquire 30 seconds of data. In the depicted exemplary embodiment, the data acquisition box 110 obtains samples at a rate of about 40 kHz; however, in alternative embodiments a different sampling rate may be used. For example, typical rates may be between 1 kHz and 100 kHz and, more particularly, in one embodiment between 10 kHz and 76 kHz. Following acquisition, this data is digitized and transmitted to the signal processing device 108 where the processor 104 filters it and applies the method 400 to it to determine the relative depth of the acoustic event relative to the depth at which the 30 second measurement was taken. The window length can be chosen in accordance with, for example, the frequencies of the filters used for signal conditioning and the frequencies of the acoustic signals. For example, where the cutoff frequencies for one of the bandpass filters used to condition the acoustic signals are 1 kHz and 2 kHz, the period of the acoustic signals output from the filter may be as long as 1 ms. The window length can thus be chosen to be 10×1 ms=10 ms, which means that at least 10 periods of the acoustic signals are captured in each window. Using a window length of 10 ms, each of the acoustic signals is divided into 3,000 windows, for a total of 3,000 window pairs $w_{k_pair}$. The lag matrix for each of the window pairs $w_{k_pair}$ is determined, and assuming the minimum cross-correlation threshold and the minimum and maximum time lag requirements are satisfied, the cross-correlations of the window pairs $w_{k_pair}$ are used to determine whether the acoustic event is deeper or shallower than the depth in the wellbore 134 at which the acoustic signals were sampled. After one depth in the wellbore 134 has been logged, the spooling mechanism 112 unravels another 5 m and the next depth in the wellbore 134 is logged until the bottom of the wellbore 134 is reached and the entire wellbore 134 has been logged.

Beneficially, the foregoing exemplary method to determine the relative depth of the acoustic event within the wellbore 134 is sufficiently efficient to generate real-time results when employed in the field. The user may alter the depths at which the acoustic events are measured in response to the real-time results. For example, if the user is initially measuring at depth increments of 10 m and determines that the acoustic event is located between 500 m and 510 m, instead of continuing to measure at depths of 520 m and deeper the user may decide to return to the interval between 500 m and 510 m and measure it in more granular increments, such as increments of 1 m, to more precisely determine the depth of the acoustic event.

Figure 7:
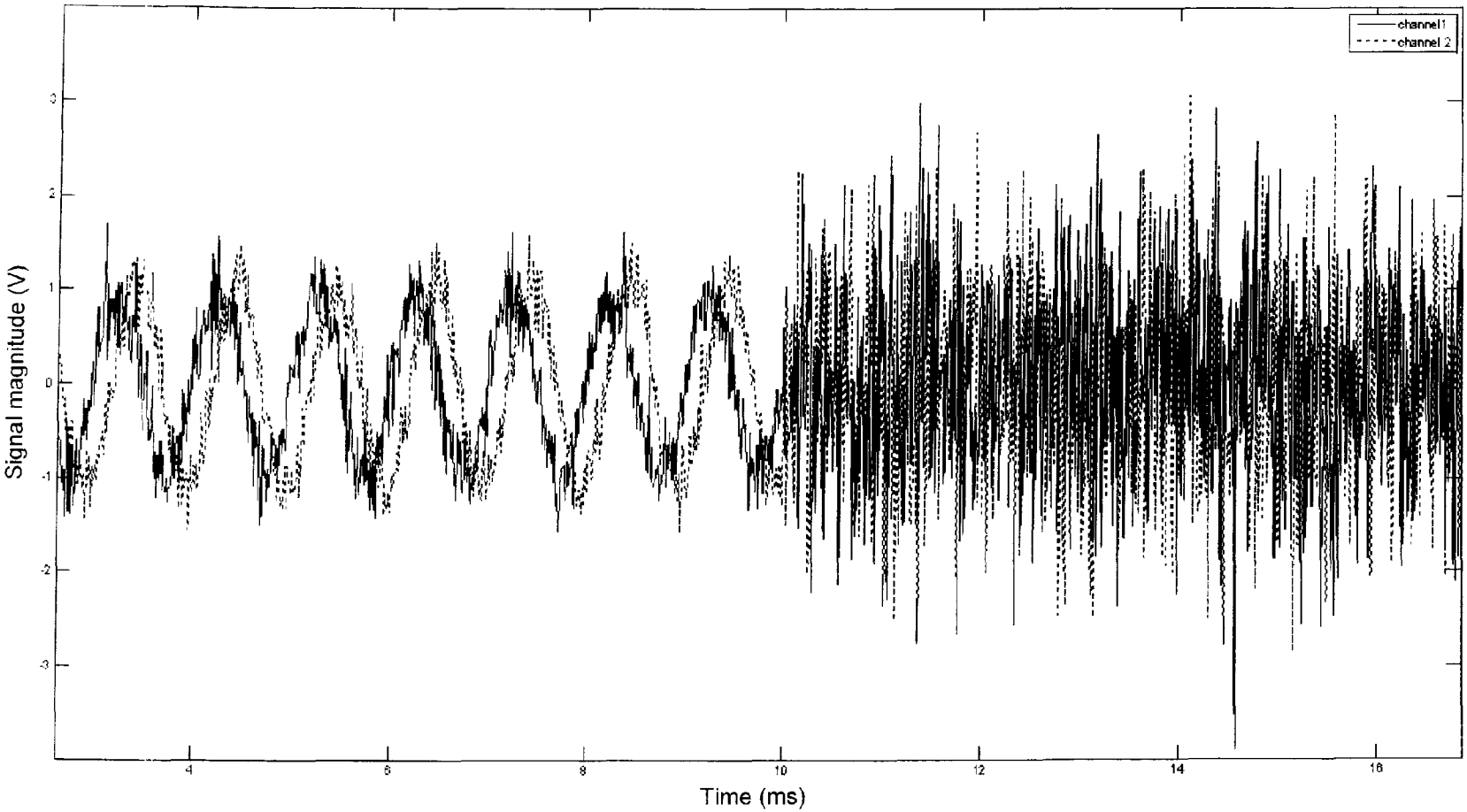
FIG. 7 depicts another pair of acoustic signals acquired using the system of FIG. 1, in which a relatively high level of noise is present for approximately half the signals' duration.

Also beneficially, dividing the acoustic signals into the windows $w_1 \ldots w_n$ helps to compensate for non-idealities encountered in the field. Such non-idealities include, for example, multiple acoustic events having sources located at different depths simultaneously making noise, acoustic events having frequencies that vary over time, acoustic reflections, and interference. If, in an ideal situation a first acoustic signal would always lead a second acoustic signal by a certain phase, the non-idealities can result in variance in the amount by which the first acoustic signal leads the second acoustic signal, and can even cause the second acoustic signal to occasionally lead the first acoustic signal. Dividing the acoustic signals into the windows $w_1 \ldots w_n$ helps to mitigate the detrimental effects of such non-idealities better than if a single cross-correlation were performed using the entirety of the acoustic signals. For example, FIG. 7 shows a pair of acoustic signals in which Channel 1 leads Channel 2, but in which this is obscured by noise for slightly under half the duration of the signals. With windowing, if the processor 104 is configured to determine that when, for example, at least 45% of the window pairs $w_{k_pair}$ show that when Channel 1 leads Channel 2 the acoustic signal of Channel 1 leads that of Channel 2 for the entire duration of the signals, the processor 104 is able to correctly determine that the Channel 1 signal leads the Channel 2 signal notwithstanding the presence of noise, which may have prevented the processor 104 from arriving at this determination if only a single cross-correlation were performed using the entirety of the noise-corrupted signals. The use of windowing allows the portions of the signals relatively unaffected by noise to form the basis of the processor 104's determination.

While the foregoing discusses one exemplary embodiment, alternative embodiments (not depicted) are possible. For example, instead of relying on the maximum cross-correlation in the lag matrix to determine relative position, the processor 104 may instead determine an average of some or all of the cross-correlations in the lag matrix. For example, the average cross-correlation of all of the values in the lag matrix for which the channel 1 vector leads the channel 2 vector may be determined and vice-versa, and these average values may be used to determine relative position. Alternatively, outliers in the lag matrix may be removed and only the remaining values in the lag matrix considered.

Additionally, in the foregoing embodiments the acoustic signals are divided into window pairs $w_{k_pair}$ in which each of the windows of the pair overlap in their entireties. In alternative embodiments (not shown), different windows may have different start and end times or be of different durations such that they only partially overlap with each other. For example, windows of different lengths may be cross-correlated with each other by zero padding the shorter of the windows to allow a cross-correlation algorithm to be performed on the window pair $w_{k_pair}$.

Alternative embodiments may also include more than one pair of pressure sensing regions 124. For example, in one alternative embodiment, in addition to the shallower and deeper pressure sensing regions 124*a,b*, an additional pair of pressure sensing regions 124 can be located along the fiber optic cable 130. The shallower and deeper pressure sensing regions 124*a,b* may be located, for example, respectively at depths of 1 m and 1.1 m, while the additional pair of pressure sensing regions 124 may be located at depths of 5 m and 5.1 m. Because there are two pairs of sensors, the rate at which the cable 130 is lowered into the wellbore 134 can be doubled relative to the embodiment in which there is only one pair of sensors. In another exemplary alternative embodiment, a third pressure sensing region can be used in conjunction with the pair of pressure sensing regions 124. For example, the third pressure sensing region can be located at a depth deeper than the deeper pressure sensing region 124*b*. In addition to determining the relative depth of the acoustic event relative to the pair of pressure sensing regions 124, the depth of the acoustic event can also be determined relative to one of the pressure sensing regions 124 and to the third pressure sensing region. If the two relative depth determinations accord with each other (e.g.: they both indicate that the acoustic event is emanating from deeper than the third pressure sensing region), then they can be used; otherwise (e.g.: the reading from the pair of pressure sensing regions 124 indicates that the acoustic event is emanating from above the shallower pressure sensing region 124*a*, while the reading from the deeper pressure sensing region 124*b* and the third pressure sensing region indicate that the acoustic event is emanating from below the third pressure sensing region) the relative depth determination can be discarded and the acoustic event can be measured again.

The processor 104 used in the foregoing embodiments may be, for example, a microprocessor, microcontroller, programmable logic controller, field programmable gate array, or an application-specific integrated circuit. Examples of the computer readable medium 106 include disc-based media such as CD-ROMs and DVDs, magnetic media such as hard drives and other forms of magnetic disk storage, semiconductor based media such as flash media, random access memory, and read only memory.

For the sake of convenience, the exemplary embodiments above are described as various interconnected functional blocks. This is not necessary, however, and there may be cases where these functional blocks are equivalently aggregated into a single logic device, program or operation with unclear boundaries. In any event, the functional blocks can be implemented by themselves, or in combination with other pieces of hardware or software.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A method for determining relative depth of an acoustic event within a wellbore, the method comprising:

(a) obtaining two acoustic signals at two different and known depths in the wellbore, wherein each of the acoustic signals includes the acoustic event;

(b) dividing each of the acoustic signals into windows, each of which has a certain duration;

(c) determining cross-correlations of pairs of the windows, wherein each of the pairs comprises one window from one of the acoustic signals and another window from the other of the acoustic signals that at least partially overlap each other in time; and (d) determining the relative depth of the acoustic event relative to the two known depths from the cross-correlations, wherein the acoustic event comprises fluid flowing from formation into the wellbore, fluid flowing from the wellbore into the formation, or fluid flowing across any casing or tubing located within the wellbore.

2. A method as claimed in claim 1 further comprising simultaneously measuring the acoustic event at the two different and known depths to generate the two acoustic signals.

3. A method as claimed in claim 1 wherein only the results of the cross-correlations that exceed a minimum cross-correlation threshold are considered when determining the depth of the acoustic event.

4. A method as claimed in claim 1 wherein the windows that comprise any one of the pairs of the windows represent concurrent portions of the acoustic signals.

5. A method as claimed in claim 1 wherein the windows into which any one of the acoustic signals is divided do not overlap with each other.

6. A method as claimed in claim 1 wherein determining the cross-correlations of the pairs of the windows comprises:

(a) for each of the pairs in a plurality of the pairs of the windows:

(i) determining the cross-correlation between the windows of the pair at a plurality of phase differences between the windows of the pair;

(ii) identifying which of the phase differences corresponds to a maximum cross-correlation between the windows of the pair; and (iii) determining whether the acoustic event as measured in the windows of the pair is above the shallower one of the two known depths or below the deeper one of the two known depths from the phase difference that corresponds to the maximum cross-correlation;

and wherein determining the relative depth of the acoustic event comprises:

(b) determining how many of the plurality of the pairs indicates that the acoustic event is above the shallower one of the two known depths or below the deeper one of the two known depths; and (c) determining whether the acoustic event is above the shallower one of the two known depths or below the deeper one of the two known depths from how many of the plurality of the pairs indicate that the acoustic event is above the shallower one of the two known depths or below the deeper one of the two known depths.

7. A method as claimed in claim 6 further comprising:

(a) comparing the phase difference that corresponds to the maximum cross-correlation to a maximum time lag; and (b) only using the phase difference that corresponds to the maximum cross-correlation to determine the relative depth of the acoustic event when the phase difference is less than the maximum time lag.

8. A method as claimed in claim 7 wherein obtaining the two acoustic signals comprises measuring the acoustic event at the two different and known depths using a fiber optic sensor assembly comprising a fiber optic cable having two pressure sensing regions spaced from each other, and wherein each of the pressure sensing regions has top and bottom ends and the maximum time lag is the time for sound to travel between the top end of the shallower one of the pressure sensing regions to the bottom end of the deeper one of the pressure sensing regions.

9. A method as claimed in claim 6 further comprising:

(a) comparing the phase difference that corresponds to the maximum cross-correlation to a minimum time lag; and (b) only using the phase difference that corresponds to the maximum cross-correlation to determine the relative depth of the acoustic event when the phase difference exceeds the minimum time lag.

10. A method as claimed in claim 9 wherein obtaining the two acoustic signals comprises measuring the acoustic event at the two different and known depths using a fiber optic sensor assembly comprising a fiber optic cable having two pressure sensing regions spaced from each other, and wherein each of the pressure sensing regions has top and bottom ends and the minimum time lag is the time for sound to travel between the bottom end of the shallower one of the pressure sensing regions to the top end of the deeper one of the pressure sensing regions.

11. A method as claimed in claim 6 wherein the relative depth of the acoustic event is determined relative to a deeper pair and a shallower pair of the two known depths, and further comprising determining that the acoustic event is located between the deeper and shallower pairs of the two known depths when a majority of the pairs of windows corresponding to the shallower pair indicates that the acoustic event occurred below the shallower pair and a majority of the pairs of windows corresponding to the deeper pair indicates that the acoustic event occurred above the deeper pair.

12. A method as claimed in claim 1 further comprising, prior to determining the cross-correlations of the pairs of the windows, filtering from the acoustic signals frequencies exceeding 20,000 Hz.

13. A method as claimed in claim 1 further comprising, prior to determining the cross-correlations of the pairs of the windows, filtering out of the acoustic signals frequencies outside of between about 10 Hz to about 200 Hz, between about 200 Hz to about 600 Hz, between about 600 Hz and 1 kHz, or about 1 kHz and greater.

14. A method as claimed in claim 1 further comprising, prior to determining the cross-correlations of the pairs of the windows, conditioning the acoustic signals by filtering the acoustic signals in parallel.

15. A system for determining relative depth of an acoustic event within a wellbore, the system comprising:

(a) a fiber optic sensor assembly comprising a fiber optic cable having two pressure sensing regions spaced from each other, wherein the fiber optic sensor assembly is configured to measure the acoustic event using the two pressure sensing regions and to correspondingly output two analog acoustic signals;

(b) a spooling mechanism on which the fiber optic cable is wound and that is configured to lower and raise the fiber optic cable into and out of the wellbore;

(c) a data acquisition box communicatively coupled to the fiber optic assembly and configured to digitize the acoustic signals;

(d) a processor communicatively coupled to:

(i) the data acquisition box to receive the acoustic signals that have been digitized; and (ii) a computer readable medium having encoded thereon statements and instructions to cause the processor to perform a method comprising:

(1) obtaining two acoustic signals at two different and known depths in the wellbore using the pressure sensing regions, wherein each of the acoustic signals includes the acoustic event;

(2) dividing each of the acoustic signals into windows, each of which has a certain duration;

(3) determining cross-correlations of pairs of the windows, wherein each of the pairs comprises one window from one of the acoustic signals and another window from the other of the acoustic signals that at least partially overlap each other in time; and (4) determining the relative depth of the acoustic event relative to the two known depths from the cross-correlations, wherein the acoustic event comprises fluid flowing from formation into the wellbore, fluid flowing from the wellbore into the formation, or fluid flowing across any casing or tubing located within the wellbore.

16. A non-transitory computer readable medium having encoded thereon statements and instructions to cause a processor to perform a method for determining relative depth of an acoustic event within a wellbore, the method comprising:

(a) obtaining two acoustic signals at two different and known depths in the wellbore, wherein each of the acoustic signals includes the acoustic event;

(b) dividing each of the acoustic signals into windows, each of which has a certain duration;

(c) determining cross-correlations of pairs of the windows, wherein each of the pairs comprises one window from one of the acoustic signals and another window from the other of the acoustic signals that at least partially overlap each other in time; and (d) determining the relative depth of the acoustic event relative to the two known depths from the cross-correlations, wherein the acoustic event comprises fluid flowing from formation into the wellbore, fluid flowing from the wellbore into the formation, or fluid flowing across any casing or tubing located within the wellbore.

* * * * *